US007458901B2

(12) United States Patent
Hoganson

(10) Patent No.: US 7,458,901 B2
(45) Date of Patent: Dec. 2, 2008

(54) GOLFER'S HEAD MOVEMENT MONITOR DEVICE AND METHOD

(76) Inventor: Eugene M. Hoganson, 2085 Seven Lakes S., West End, NC (US) 27376

( * ) Notice: Subject to any disclaimer, the term of this patent is extended or adjusted under 35 U.S.C. 154(b) by 62 days.

(21) Appl. No.: 11/355,967

(22) Filed: Feb. 17, 2006

(65) Prior Publication Data

US 2006/0189405 A1 Aug. 24, 2006

Related U.S. Application Data

(60) Provisional application No. 60/654,459, filed on Feb. 22, 2005.

(51) Int. Cl.
*A63B 69/36* (2006.01)

(52) U.S. Cl. ..... 473/268

(58) Field of Classification Search ..... 473/266, 473/268

See application file for complete search history.

(56) References Cited

U.S. PATENT DOCUMENTS 3,468,545 A * 9/1969 Anderson ..... 473/268
3,992,011 A * 11/1976 Jessee ..... 473/268
4,032,157 A * 6/1977 Carpenter ..... 473/268
4,483,536 A * 11/1984 Mitchell ..... 473/268
4,963,314 A * 10/1990 Gering et al. ..... 473/268
5,330,191 A * 7/1994 Hoganson ..... 473/268
5,338,037 A * 8/1994 Toyohara ..... 473/268
5,409,232 A * 4/1995 Hoganson ..... 473/268
5,624,327 A * 4/1997 Smith ..... 473/268
6,612,937 B1 * 9/2003 Whelan ..... 473/268
2006/0189405 A1 * 8/2006 Hoganson ..... 473/268

* cited by examiner

*Primary Examiner*—Raleigh W. Chiu
(74) *Attorney, Agent, or Firm*—Adesh Bhargava; Dykema Gossett PLLC

(57) ABSTRACT

A system and method for determining an amount and direction of a golfer's head movement as the golfer executes a golf swing. The system may include at least two light baffles for monitoring the golfer's head movement along a path generally parallel to a target line. The baffles may reflect light into the golfer's eyes when the golfer's head is either outside and to the left of a preset range, or outside and to the right of the preset range. The system may further include at least two additional light baffles for monitoring lunging and bobbing head motion. The additional light baffles may reflect light into the golfer's eyes when the golfer's head lunges or bobs beyond a further preset range.

12 Claims, 7 Drawing Sheets

38
36

20
38
36
32

30
2
4
6
8
10
36
32
44
30

FIG. 4C
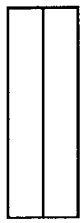
FIG. 4A
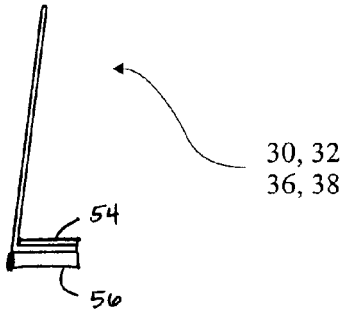
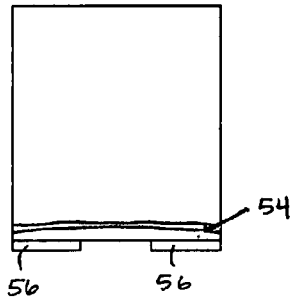
FIG. 4B
FIG. 4D
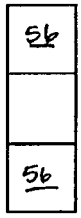

FIG. 5C
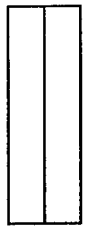
FIG. 5A
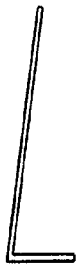
30, 32
36, 38
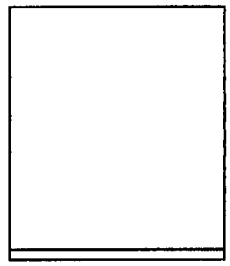
FIG. 5B
FIG. 5D
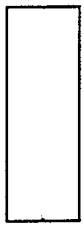

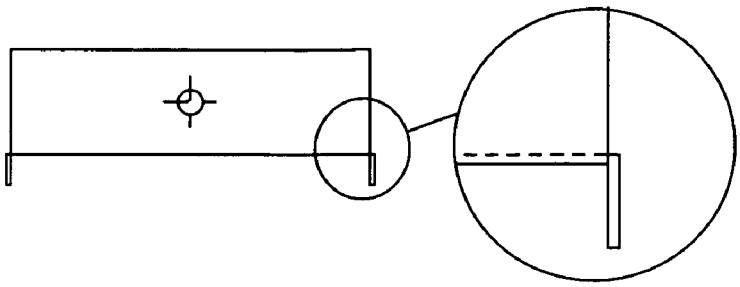
FIG. 6B
FIG. 6D
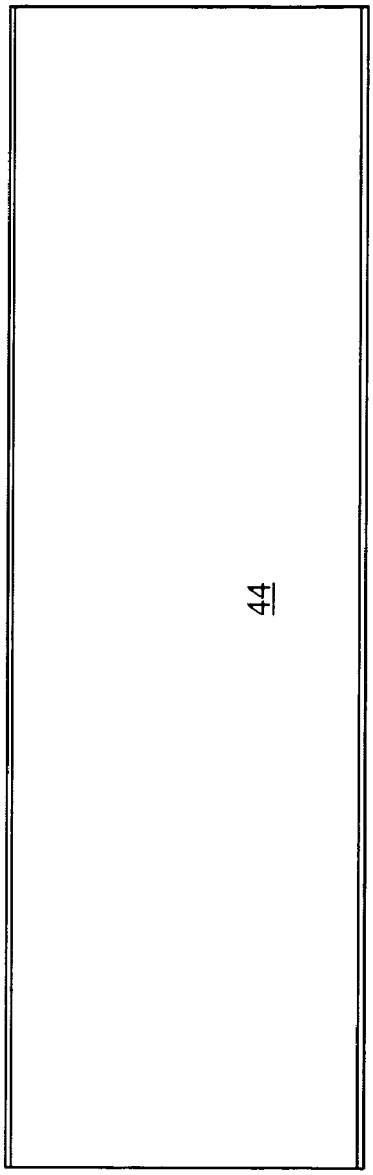
FIG. 6A
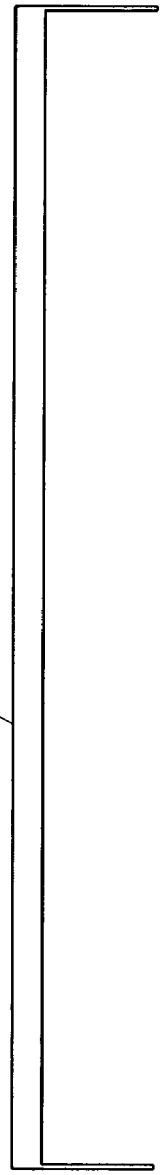
FIG. 6C

GOLFER'S HEAD MOVEMENT MONITOR DEVICE AND METHOD

RELATED APPLICATIONS

This application claims benefit of priority of Provisional Application Serial No. 60/654,459, filed Feb. 22, 2005, hereby incorporated by reference in its entirety.

BACKGROUND OF INVENTION a. Field of Invention

The present invention relates generally to devices used for assisting an individual with a golf swing, and more particularly to a golfer's head movement monitor device to be used when practicing a normal golf swing.

b. Description of Related Art

An important feature during the search for a good golf swing is to establish the amount and direction of head movement that occurs when a golf swing yields optimum direction and distance. Excessive head movement is probably the most common error occurring with non-expert golfers. This movement may be lateral movement of the head in a direction that is generally parallel with the intended line of flight of the golf ball. The movement may also be from front to back relative to the golfer's body, or it may be in an up and down direction. Since there are several possible types of movement of the golfer's head, it is difficult to monitor.

Many different devices have been proposed in the prior art for monitoring a golfers head movement. For example, U.S. Pat. No. 1,677,261 discloses a sheet of opaque material supported above a golf ball and having a slot therein through which the golfer views a golf ball while swinging. This device will indicate lateral movement of the head, but it will not indicate front and back or up and down movement.

U.S. Pat. No. 3,992,011 discloses a hollow tee through which light shines. The golfer takes his stance and initially observes the light beam. A ball is then placed on the tee and the golfer swings to knock the ball off of the tee. After the swing is completed, the golfer re-observes the light to check and see if he has held his head still. This device provides information as to head position only after the golf ball has been struck, and it may be difficult to determine just what type of movement has taken place.

Accordingly, it is a principal objective of the invention to provide a device which will monitor head movement throughout a golf swing and which will readily identify the type and amount of head movement which is occurring. It is also an objective of the invention to provide a golfer's head movement monitor device which is simple to use, and which is economical to manufacture and assemble.

SUMMARY OF INVENTION

The present invention thus solves the problems and overcomes the drawbacks and deficiencies of prior art golf swing assistance devices by providing a system for determining an amount and direction of a golfer's head movement as the golfer executes a golf swing. The system may include at least two light baffles for monitoring the golfer's head movement along a path generally parallel to a target line. The baffles may reflect light into the golfer's eyes when the golfer's head is either outside and to the left of a preset range, or outside and to the right of the preset range.

For the system described above, the system may further include at least two additional light baffles for monitoring lunging and bobbing head motion. The additional light baffles may reflect light into the golfer's eyes when the golfer's head lunges or bobs beyond a further preset range. The additional light baffles may be disposed generally transverse to the baffles for monitoring the golfer's head movement along the path generally parallel to the target line. Each of the baffles may include a base for removable and slidable attachment of the baffles to a baffle mounting platform, and in a particular configuration, each of the baffles may include a magnetic base for removable and slidable attachment of the baffles to the baffle mounting platform. The baffle mounting plate may be rotatably mounted to at least two legs for enabling rotation of the baffles generally about the mounting platform tilt axis. Each of the baffles may include a base and a leg disposed generally transverse to the base. Further, each of the baffles may include a colored tape attached thereon for reflecting light at a predetermined color. The baffles may be movable relative to each other generally parallel to the target line for reflecting light into the golfer's eyes when the golfer's head is either outside and to the left of the preset range, or outside and to the right of the preset range. Yet further, the additional baffles may be movable generally orthogonal to the target line for reflecting light into the golfer's eyes when the golfer's head lunges or bobs beyond the further preset range. In a particular embodiment of the present invention, the light may be ambient light.

The invention also provides a method for determining an amount and direction of a golfer's head movement as the golfer executes a golf swing. The method may include monitoring the golfer's head movement along a path generally parallel to a target line by at least two light baffles for reflecting light into the golfer's eyes when the golfer's head is either outside and to the left of a preset range, or outside and to the right of the preset range.

The method may further include monitoring lunging and bobbing head motion by at least two additional light baffles reflecting light into the golfer's eyes when the golfer's head lunges or bobs beyond a further preset range. The additional light baffles may be disposed generally transverse to the baffles for monitoring the golfer's head movement along the path generally parallel to the target line.

For the method described above, each of the baffles may include a base for removable and slidable attachment of the baffles to a baffle mounting platform, and in a particular configuration, each of the baffles may include a magnetic base for removable and slidable attachment of the baffles to the baffle mounting platform. The baffle mounting plate may be rotatably mounted to at least two legs for enabling rotation of the baffles generally about the mounting platform tilt axis. Each of the baffles may include a base and a leg disposed generally transverse to the base. Further, each of the baffles may include a colored tape attached thereon for reflecting light at a predetermined color. The baffles may be movable relative to each other generally parallel to the target line for reflecting light into the golfer's eyes when the golfer's head is either outside and to the left of the preset range, or outside and to the right of the preset range. Yet further, the additional baffles may be movable generally orthogonal to the target line for reflecting light into the golfer's eyes when the golfer's head lunges or bobs beyond the further preset range. In a particular embodiment of the present invention, the light may be ambient light.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings:

FIGS. 4A-4D respectively include front, side, top and bottom views of a baffel sub-assembly used with the no-sway system of FIG. 1;

FIGS. 5A-5D respectively include front, side, top and bottom views of a baffle used with the no-sway system of FIG. 1;

FIGS. 6A-6C respectively include top, right side and front views of a baffle mounting platform according to the present invention, and FIG. 6D includes an enlarged view of a corner section of the baffle mounting platform;

DETAILED DESCRIPTION OF THE PREFERRED EMBODIMENT

Figure 1:
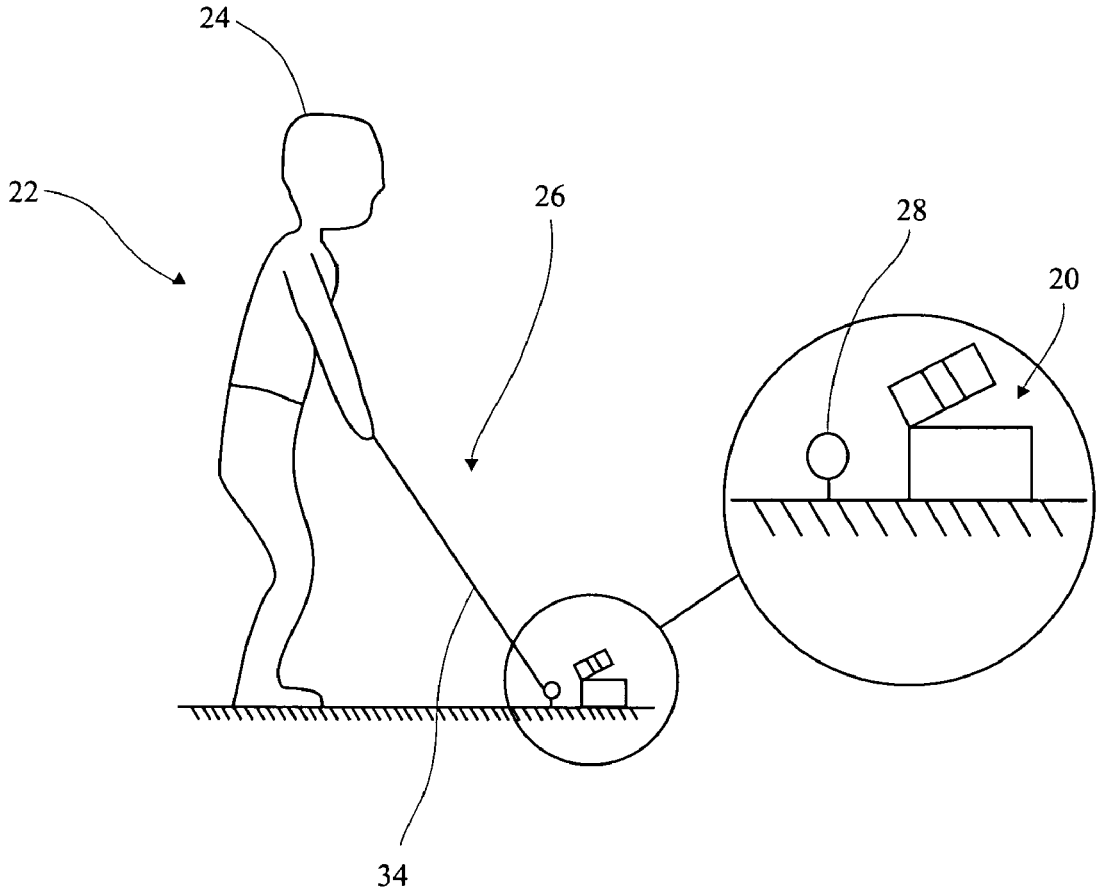
FIG. 1 is a view illustrative of a golfer in position for executing a golf swing, with the no-sway system of the present invention in position for monitoring the golfer's head movement.

Referring now to the drawings wherein like reference numerals designate corresponding parts throughout the several views, FIGS. 1-8B illustrate a system for determining the amount and direction of a golfer's head movement as the golfer executes the golf swing, the system being hereinafter referred to as no-sway system 20.

Systems similar in principal to no-sway system 20 are disclosed in U.S. Pat. Nos. 5,330,191 and 5,409,232, commonly owned herewith and the respective disclosures of which are incorporated herein by reference.

For the present invention, it has been observed that the majority of expert golfers, during the back swing, limit their head movement that is generally parallel to the intended line of flight of the ball (i.e. target line), to less than four inches from the address position and in a direction away from the target. Expert golfers let their head float and rotate about their spine while keeping their head position in the middle of their shoulders. Zero head movement during the back swing is to be avoided as this promotes reverse pivot. Limited movement of the golfer's head during the transition from back swing to forward swing, with a move toward the target of the lower left side (hip to knee) allows the hands to drop down without spoiling the torsion built up between the shoulders and hips during the back swing (i.e. keep buttons on front of shirt facing away from the target). This will provide the benefit of urging the lower body to lead the arms and shoulders during the forward swing. Additionally, at impact, a head position that is at, or in back (further from the target) of the address head position, enhances the power delivered to the ball; i.e., a power robbing situation occurs when the golfers head position drifts past the address head position (closer to the target) at impact.

By taking the noted golf swing and head movement considerations into account, referring to FIGS. 1-8B of the present invention, the function of no-sway system 20 is to provide a golfer 22 with a means to determine the amount and direction his/her head 24 moves as the golfer executes the golf swing at 26 and with the object to use this information to optimize ball travel distance and accuracy. While there is no known formula for the perfect and exact golfer head position during the golf swing as each golfer is unique (size, strength, flexibility etc), with no-sway system 20, each golfer can identify head positions that yield the best results.

Figure 2:
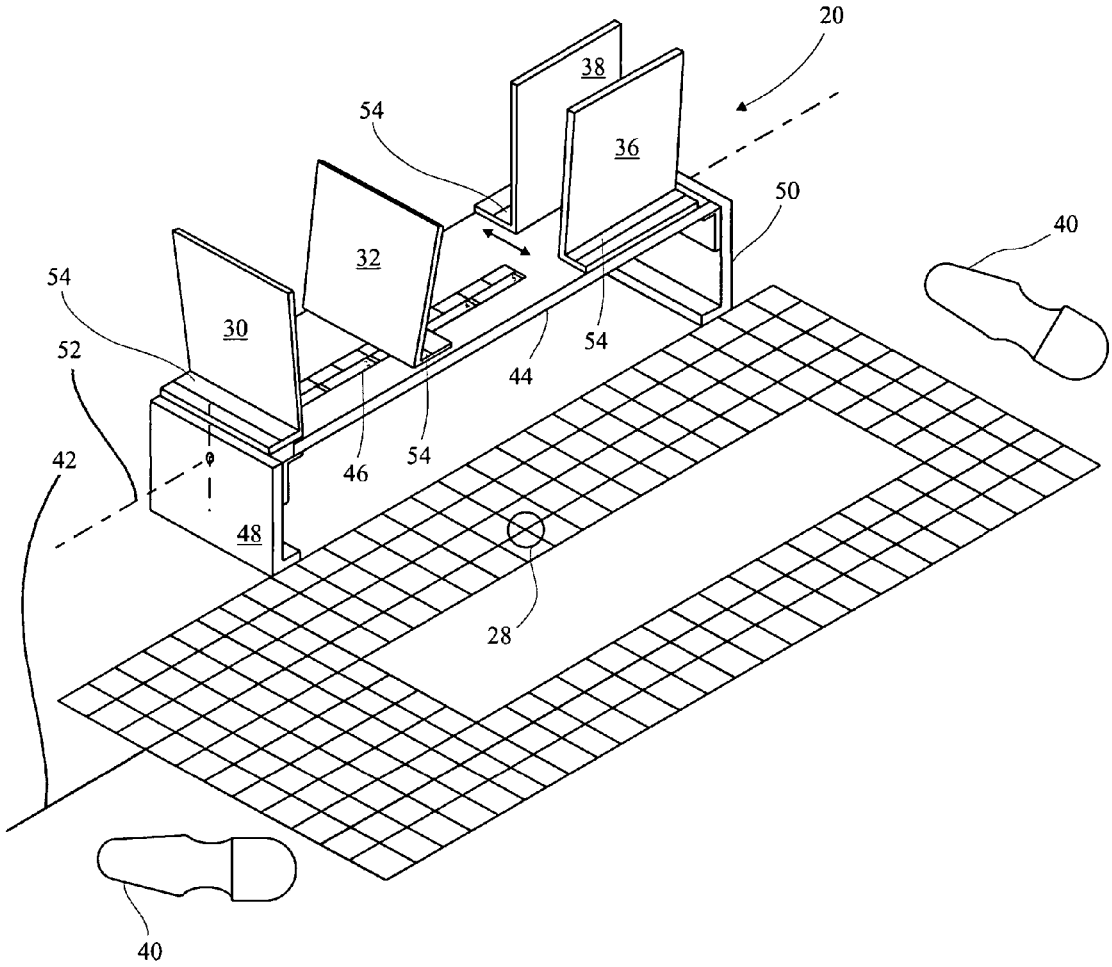
FIG. 2 is an enlarged isometric view of the no-sway system of FIG. 1.
Figures 3A, 3B, 3C, 3D, 3E:
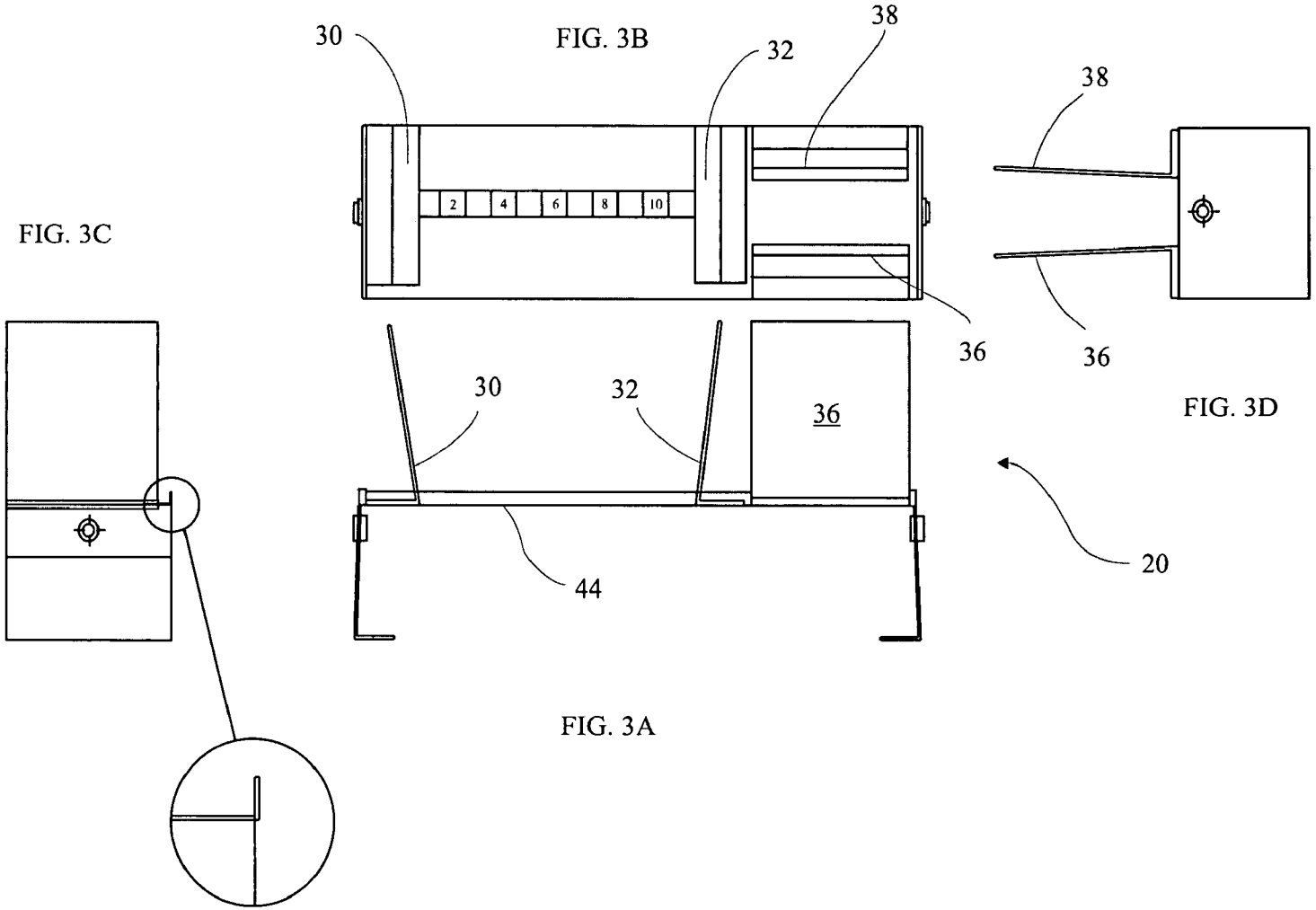
FIGS. 3A-3E respectively include front, top, left, right side and an enlarged partial view of the no-sway system of FIG. 1.
Figure 7:
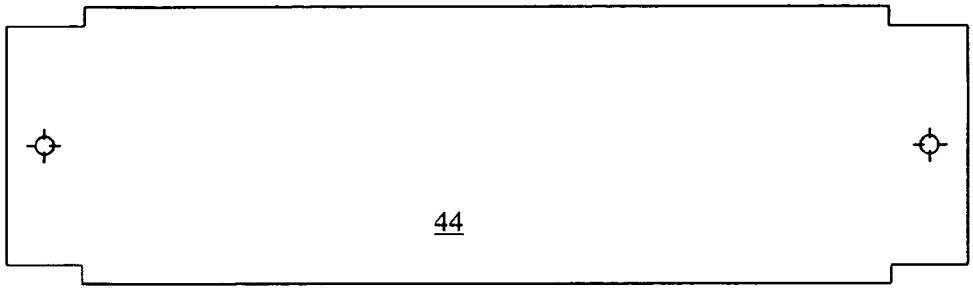
FIG. 7 shows a cut sheet configuration for the baffle mounting platform of FIG. 6A.
Figures 8A, 8B:
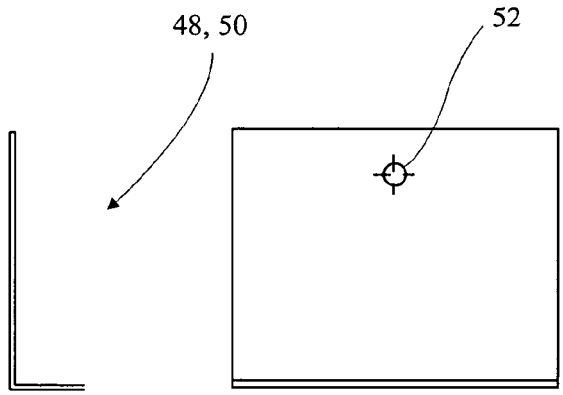
FIGS. 8A-8B respectively include side and front views of a leg used with the no-sway system of FIG. 1.

Specifically, during the golf swing at 26, no-sway system 20 is designed to identify the golfer's head positions as they relate to the golf ball 28 and the golfer's head position at address. How far the golfer's head moves parallel to the intended line of flight of golf ball 28 is measured with two adjustably positioned inclined baffles 30, 32. For example, to monitor head position while executing a full swing with a golf club or training club 34, the golfer is to take his/her normal stance with respect to golf ball 28 with the golfer's feet positioned at locations 40. No-sway system 20 may be placed on the ground as shown in FIGS. 1 and 2 on the far side of the golf ball (or imaginary golf ball) with the mounting platform tilt axis 52 parallel to the target line and in a position such that any head movement toward the target (i.e. flag or hole) along target line 42 would signal the golfer that he/she has done so. Additionally, if, while during the back swing the golfer's head 24 moves away from the target and past the limit preset into system 20, the golfer would be signaled that he/she has done so. The preset limit may be set by moving baffles 30, 32 relative to each other along baffle mounting platform 44 in a direction parallel to mounting platform tilt axis 52.

No-sway system 20 works on the principle of either blocking or admitting reflected ambient light to the golfer's eyes. Whether the light is blocked or admitted depends on the golfer's head position with respect to no-sway system 20. Reflected light establishes that the golfer's head 24 is outside the preset range and no reflected light establishes that the golfers head 24 is within the preset range. Thus reflected light readily signals to a golfer when his/her head moves beyond the preset limit set by system 20.

Referring to FIG. 2, as briefly discussed above, system 20 may include two light baffles 30, 32 for monitoring head movement/position along a path parallel to target line 42. Reflected light establishes that the golfer's head is either outside and to the left (toward the target) of the preset range (by means of a red color; or another color a user may desire for use with baffle 30), or outside and to the right (away from the target) of the preset range (by means of a yellow color; or another color a user may desire for use with baffle 32). The range may be adjustable between 1/32 inch to 4 inches, with baffle mounting platform 44 including markings 46 thereon for assisting a user with adjustment of baffles 30, 32. Very low head movement is usually desirable during putting. Greater ranges up to 4 inches may be utilized to monitor head motion during full swings, pitching and chipping swings.

As shown in FIG. 2, no sway system 20 further includes a second set of adjustably positioned, inclined light baffles 36, 38 used to monitor lunging and bobbing head motion during all the golf swings.

Briefly, lunging is head motion transverse to the intended line of flight of the golf ball 28 and on a plane parallel to the ground, and bobbing is head motion vertical to the ground (lifting and dropping chin). As is known in golfing, lunging and bobbing head movement during all golf swings are to be avoided as they complicate the golf swing; i.e., the golfer must make extra swing adjustments to optimize ball contact. Thus, to enhance balance, rhythm and muscle memory during the golf swing, a golfer may practice swinging within the head movement limits provided with no-sway system 20.

Thus as briefly discussed above, baffles 36, 38 may be designed in a similar manner as baffles 30, 32, but are positioned generally orthogonal to target line 42 as shown in FIG. 2. Baffles 36, 38 may also include colors such as red or yellow (or other colors; in a similar manner as baffles 30, 32) for signaling to a user when his/her head motion exceeds an acceptable lunging and bobbing head motion that exceeds the preset limit set by system 20 by adequate spacing of baffles 36, 38.

Referring to FIG. 2, the angle of baffles 30, 32, 36 and 38 may be adjusted by rotating baffle mounting platform 44 about mounting platform tilt axis 52 and relative to legs 48 and 50. In this manner, the angle of the baffles may be adjusted to account for the height of a golfer and the length of the club by rotating platform 44 and thus the baffles such that the true width of the upper area of the baffles is visible to the golfer.

In use, referring to FIGS. 1 and 2, in order to monitor head position while executing a full swing with a golf club, golfer 22 may take his normal stance with respect to the golf ball. System 20 may be placed on the ground on the far side of the golf ball (or imaginary golf ball) and in a position such that any head movement toward the target would signal the golfer that he has done so by means of light (i.e. red or another color) reflected by baffle 30. Additionally, if, while during the back swing the golfer's head moves away from the target and past the limit preset into system 20, the golfer would be signaled that he has done so by means of light (i.e. yellow or another color) reflected by baffle 32. Yet further, if the golfer's head bobs or lunges during address or during the golf swing, baffles 36, 38 may reflect light (i.e. red, yellow, green or another color) to signal that the golfer has bobbed or lunged his/her head.

No-sway system 20 thus allows for monitoring of head movement throughout a golf swing and for ready identification of the type of head movement which is occurring for an improved golf swing.

As readily evident to those skilled in the art, various modifications may be made to no-sway system 20 without departing from the scope of the present invention. For example, while the angles of the baffles may be set at approximately 82° relative to the baffle base (and mounting platform), the angles may be changed as needed for further optimization of reflected light. While the baffles may be magnetically attached by magnetic tape 56 to the mounting platform, and magnetic or non-magnetic colored reflective tape 54 may be attached to the baffles, other means of removable and slidable attachment for the baffles and magnetic tape may be used. Such means may include removable adhesive means, as well as slots, guides or other such means provided in the mounting platform for enabling removable and slidable movement of the baffles and/or the reflective tape. Yet further, as readily evident to those skilled in the art, the various components of no-sway system 20 may be cast or stamped from metal. The configuration of the baffles may also be changed so long as the baffles function to reflect light toward a user's eyes when the user's head moves outside a preset range, as discussed in detail above.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A system for determining an amount and direction of a golfer's head movement as the golfer executes a golf swing, said system comprising:

at least two light baffles for monitoring the golfer's head movement along a path generally parallel to a target line, said baffles reflecting light into the golfer's eyes when the golfer's head is either outside and to the left of a preset range, or outside and to the right of the preset range and said baffles selected from the group consisting of:

baffles including a base for removable and slidable attachment of said baffles to a baffle mounting platform;

baffles each including a base and a leg disposed generally traverse to said base; or baffles moveable relative to each other generally parallel to the target line.

2. A system according to claim 1, further comprising at least two additional light baffles for monitoring lunging and bobbing head motion, said additional light baffles reflecting light into the golfer's eyes when the golfer's head lunges or bobs beyond a further preset range, said additional light baffles disposed generally transverse to said baffles for monitoring the golfer's head movement along the path generally parallel to the target line, wherein said additional baffles are movable generally orthogonal to the target line for reflecting light into the golfer's eyes when the golfer's head lunges or bobs beyond the further preset range.

3. A system according to claim 1 wherein each of said baffles including a base for removable and slidable attachment of said baffles to a baffle mounting platform includes a magnetic base for removable and slidable attachment of said baffles to said baffle mounting platform.

4. A system according to claim 1 wherein said baffle mounting platform is rotatably mounted to at least two legs for enabling rotation of said baffles generally about a mounting platform tilt axis.

5. A system according to claim 1, wherein each of said baffles includes a colored tape attached thereon for reflecting light at a predetermined color.

6. A system according to claim 1, wherein the light is ambient light.

7. A method for determining an amount and direction of a golfer's head movement as the golfer executes a golf swing, said method comprising:

monitoring the golfer's head movement along a path generally parallel to a target line by at least two light baffles for reflecting light into the golfer's eyes, when the golfer's head is either outside and to the left of a preset range, or outside and to the right of the preset range, said baffles selected from the group consisting of:

baffles including a base for removable and slidable attachment of said baffles to a baffle mounting platform;

baffles including a base and a leg disposed generally traverse to said base; or baffles moveable relative to each other generally parallel to the target line.

8. A method according to claim 7, further comprising monitoring lunging and bobbing head motion by at least two additional light baffles reflecting light into the golfer's eyes when the golfer's head lunges or bobs beyond a further preset range, said additional light baffles disposed generally transverse to said baffles for monitoring the golfer's head movement along the path generally parallel to the target line, wherein said additional baffles are movable generally orthogonal to the target line for reflecting light into the golfer's eyes when the golfer's head lunges or bobs beyond the further preset range.

9. A method according to claim 7, wherein each of said baffles including a base for removable and slidable attachment of said baffles to a baffle mounting platform includes a magnetic base for removable and slidable attachment of said baffles to said baffle mounting platform.

10. A method according to claim 7, further comprising rotatably mounting said baffle mounting platform to at least two legs for enabling rotation of said baffles generally about a mounting platform tilt axis.

11. A method according to claim 7, wherein each of said baffles includes a colored tape attached thereon for reflecting light at a predetermined color.

12. A method according to claim 7, wherein the light is ambient light.

* * * * *